US009752263B2

(12) United States Patent
Crotta

(10) Patent No.: US 9,752,263 B2
(45) Date of Patent: Sep. 5, 2017

(54) MACHINE FOR THE TREATMENT OF FABRICS, NETS, GAUZES, FELTS, NON-WOVEN FABRICS AND OTHER PIECE OR SHEET MATERIAL

(75) Inventor: Emanuele Crotta, Urgnano (IT)

(73) Assignee: MCS OFFICINA MECCANICA S.P.A., Urgnano (BG) (IT)

( * ) Notice: Subject to any disclaimer, the term of this patent is extended or adjusted under 35 U.S.C. 154(b) by 694 days.

(21) Appl. No.: 14/241,828

(22) PCT Filed: Aug. 14, 2012

(86) PCT No.: PCT/IB2012/054138

§ 371 (c)(1),
(2), (4) Date: Feb. 27, 2014

(87) PCT Pub. No.: WO2013/030705

PCT Pub. Date: Mar. 7, 2013

(65) Prior Publication Data

US 2014/0208811 A1 Jul. 31, 2014

(30) Foreign Application Priority Data

Aug. 29, 2011 (IT) ..... MI2011A1553

(51) Int. Cl.
*D06B 3/28* (2006.01)
*D06B 23/00* (2006.01)
(Continued)

(52) U.S. Cl.
CPC ..... *D06B 3/28* (2013.01); *D06B 23/00* (2013.01); *D06B 23/04* (2013.01); *D06B 23/20* (2013.01); *F04D 29/708* (2013.01)

(58) Field of Classification Search
None
See application file for complete search history.

(56) References Cited

U.S. PATENT DOCUMENTS 4,036,038 A 7/1972 Aurich
3,685,325 A 8/1972 Carpenter
4,578,085 A * 3/1986 Ishimaru ..... D06B 3/28 26/21

FOREIGN PATENT DOCUMENTS

EP 1884583 A1 2/2008
GB 2266750 A * 11/1993
WO 2011/117763 A1 9/2011

OTHER PUBLICATIONS

International Search Report From Corresponding PCT/IB2012/054138 Dated Oct. 31, 2012.

* cited by examiner

*Primary Examiner* — Michael Barr
*Assistant Examiner* — Jason Riggleman
(74) *Attorney, Agent, or Firm* — Hedman & Costigan, P.C.; James V. Costigan; Kathleen A. Costigan

(57) ABSTRACT

The machine (1) for the treatment of fabrics according to the invention comprises a treatment tank (3) arranged for containing the fabric or other material to be treated (TC) and a treatment liquid. The head losses that the treatment liquid undergoes along the different collecting ducts (37A, 37B) between the treatment tank (3) and the relative entry nozzle (370A, 370B) in the collector (39) mutually differ at most of ±10% of the losses themselves. The head losses that the treatment liquid undergoes between each entry nozzle (370A, 370B) in the collector (39) and the entry (410) in the chamber (41) of the pump impeller differ at most of ±10% between the various entry nozzles (370A, 370B). The level of liquid on the bottom of the tank (3) is more even, and it is thus possible to make the machine (30) work with very low bath levels.

12 Claims, 6 Drawing Sheets

(51) Int. Cl.

| | |
|---|---|
| ***F04D 29/70*** | (2006.01) |
| ***D06B 23/04*** | (2006.01) |
| ***D06B 23/20*** | (2006.01) |

MACHINE FOR THE TREATMENT OF FABRICS, NETS, GAUZES, FELTS, NON-WOVEN FABRICS AND OTHER PIECE OR SHEET MATERIAL

FIELD OF THE INVENTION

The present invention concerns a machine for the treatment of fabrics, nets, gauzes, felts, non-woven fabrics and other sheet or piece materials that are substantially flexible like ordinary fabrics. In particular, the invention concerns a system for recirculating a dye bath, an aqueous washing solution or other treatment liquid with which the fabric or other material is treated in the machine.

The present application claims the priority of Italian patent application n° MI2011A001553, and incorporates the content thereof by reference.

STATE OF THE ART

There are currently known machines for the treatment of fabrics comprising an autoclave or closed treatment tank in which the fabric is inserted and brought into contact with a suitable treatment liquid, like for example a dying, washing, rinsing, scouring or bleaching bath. An example of this type of known machine is shown in FIG. 1 and is indicated with overall reference number 1. The treatment liquid, after having been brought into contact with the fabric to be treated, collects on the bottom of the treatment chamber 3, and through two collecting pipes 7A, 7B reaches a collector 9 and then a recirculation pump 11.

The latter pumps the treatment liquid towards the heat exchanger 13. The liquid is heated and then reintroduced into the treatment chamber through the recirculation pipes 15, 17, 19.

The collector 9 and in many cases also a treatment chamber 3 each have a substantially elongated shape, with substantially horizontal axes. Since the collecting pipe 7B enters into the collector 9 much further downstream than the pipe 7A, the treatment liquid that flows through the pipe 7B undergoes less head losses than the liquid that flows through the pipe 7A and therefore, when the head of the treatment liquid in the chamber 3—i.e. the so-called "bath level"—is relatively very low, above the entry mouth into the pipe 7B still tends to be lower than above the entry mouth of the pipe 7A, as shown schematically in FIG. 1, with a high risk of aspiring air into the pipe 7B and of consequent cavitation phenomena in the pump 11.

Also in the case of aspirations arranged centrally on the collector this phenomenon is less accentuated but is still present, since the flow of the bath still takes a preferential path, penalizing one or more aspirations; it must be kept in mind that a collector can even have up to six aspirations.

A known solution to such a drawback in current machines is to increase the bath level in the treatment chamber by increasing the amount of treatment liquid circulating in the machine itself.

However, current production and commercial trends of the Italian and European textile industries require working in ever smaller production batches, changing production increasingly frequently, making it increasingly desirable to have machines capable of operating with ever smaller amounts or flow rates of treatment liquid.

Therefore, a purpose of the present invention is to avoid the aforementioned drawbacks of known machines, and in particular to provide a machine for the treatment of solid materials to be treated, like for example yarns, fabrics, non-woven fabrics, felts and gauzes, which can operate with smaller quantities or flow rates of treatment liquid with respect to those of current machines.

SUMMARY OF THE INVENTION

In a first aspect of the invention, these and other purposes are accomplished by making a machine for the treatment of fabrics, nets, gauzes, felts, non-woven fabrics and other piece or sheet material having the characteristics according to claim 1.

In a second aspect of the invention, such purposes are accomplished with a machine for the treatment of fabrics, nets, gauzes, felts, non-woven fabrics and other piece or sheet material having the characteristics according to claim 14.

Further characteristics of the machine are the object of the dependent claims.

The advantages that can be obtained with the present invention will become clearer to the man skilled in the art from the following detailed description of a particular example embodiment, not for limiting purposes, illustrated with reference to the following schematic figures.

LIST OF FIGURES

Figure 2:
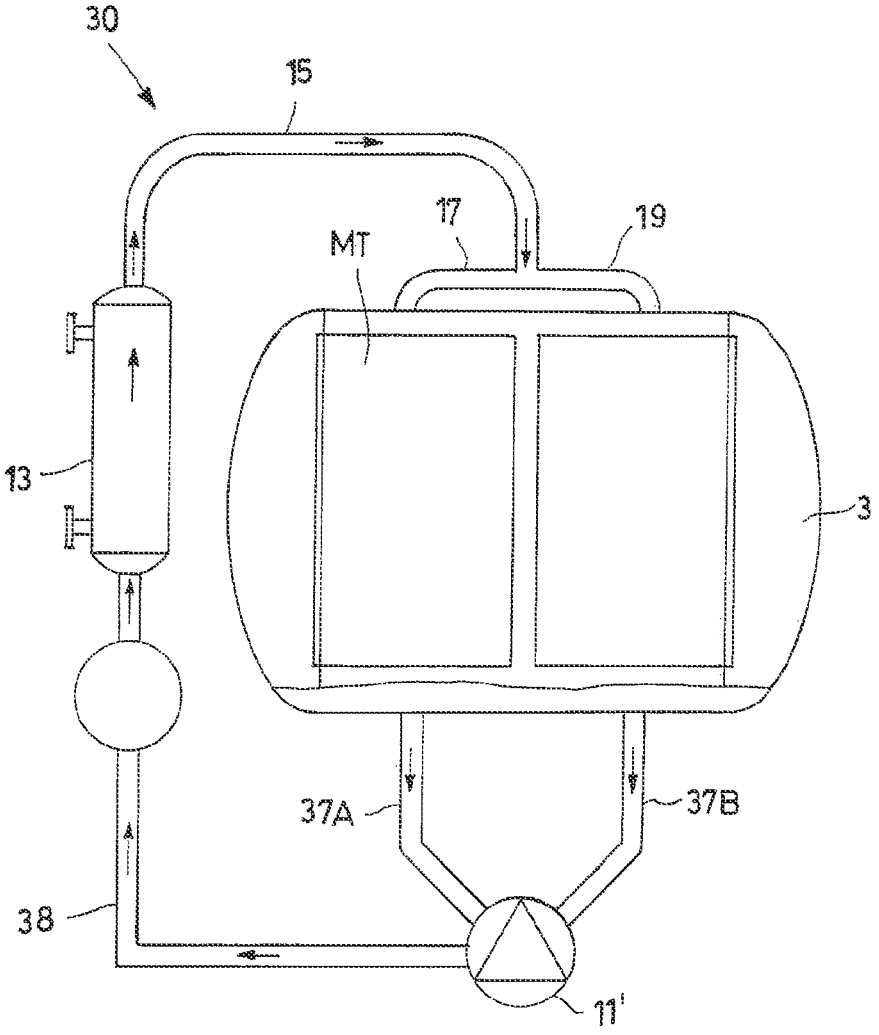
FIG. 2 shows a fluid diagram of a machine for dyeing rope fabrics according to a particular embodiment of the invention.
Figure 3:
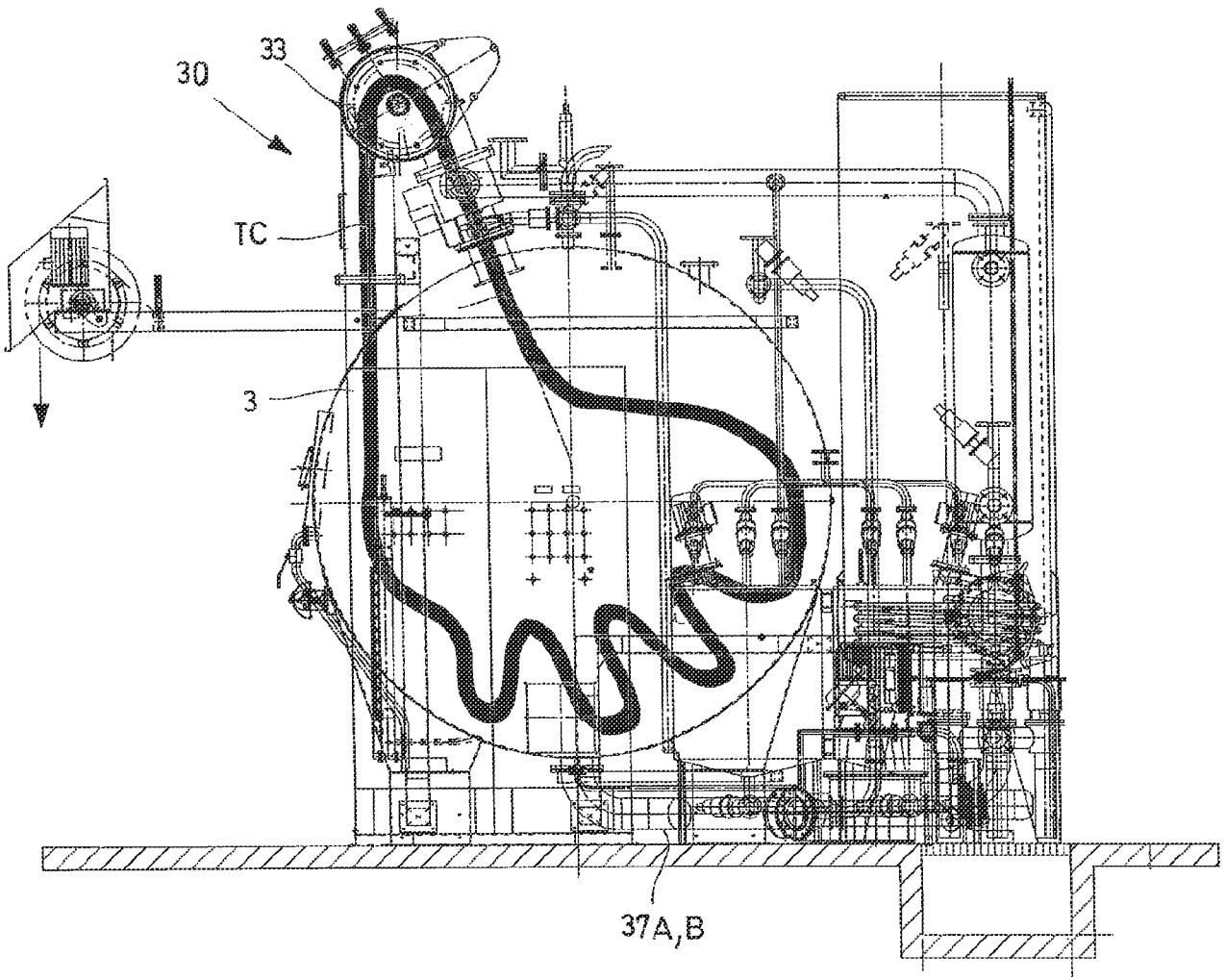
Figure 4:
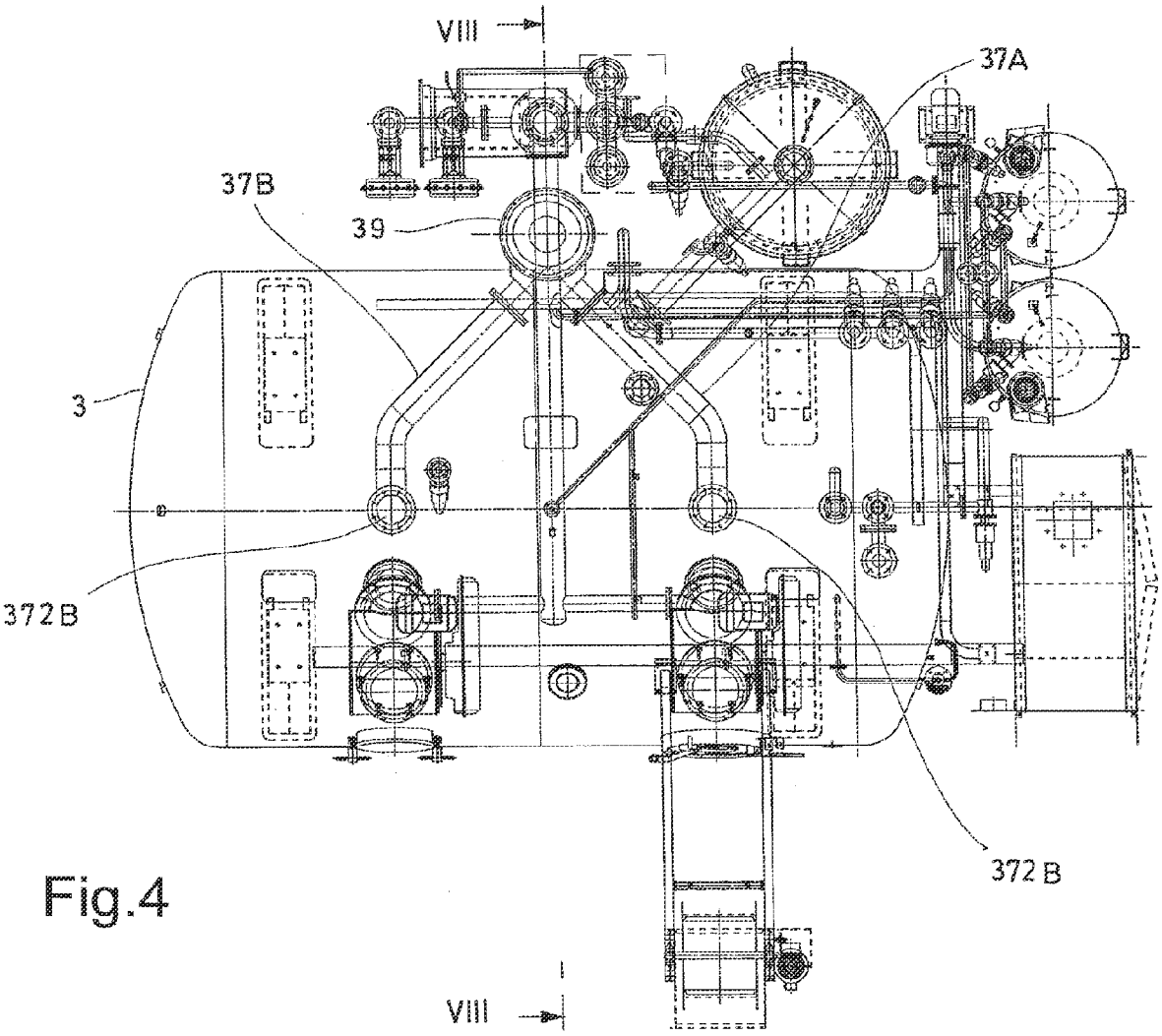
Figure 5:
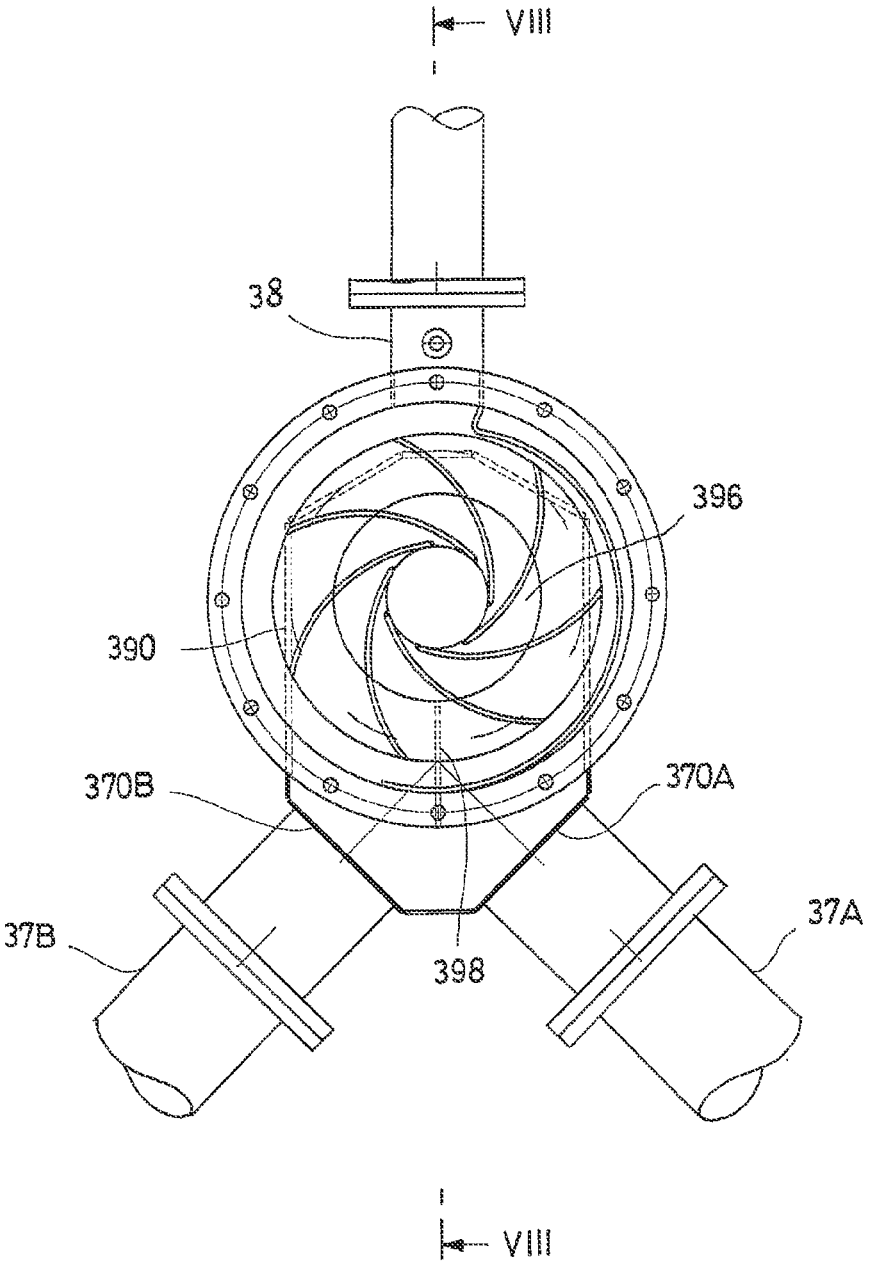
Figure 6:
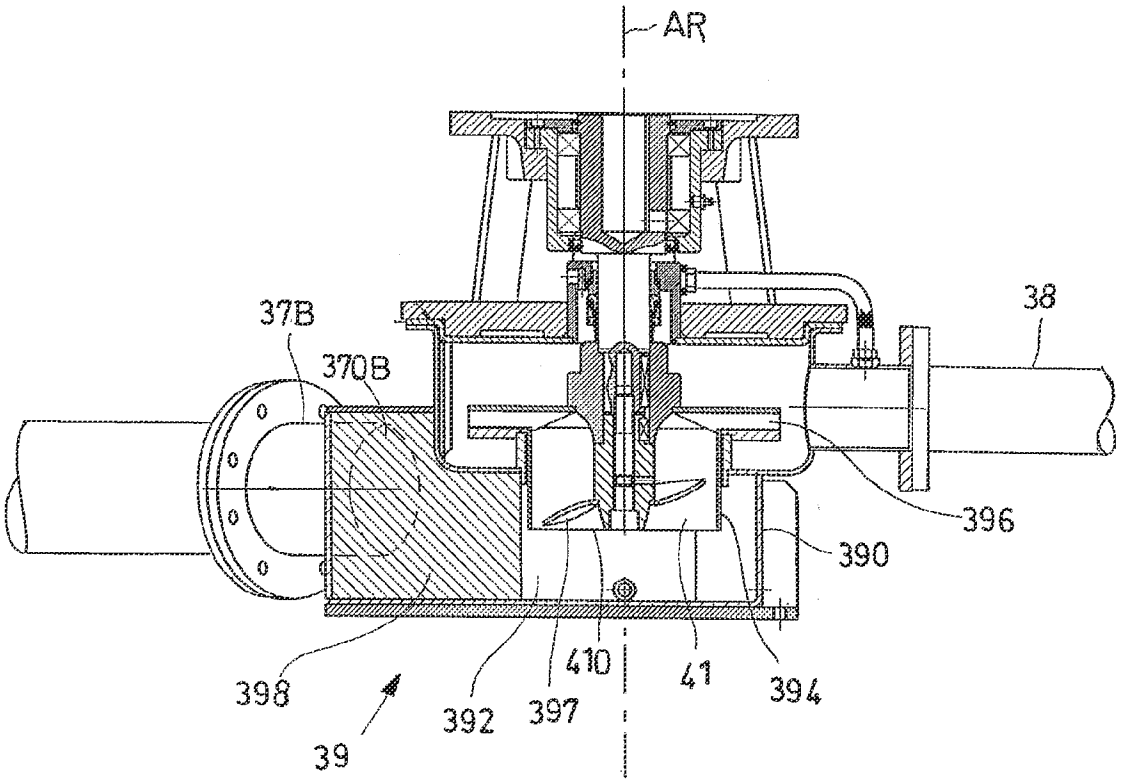

FIGS. 3 and 4 respectively show a side view and a view from above of the machine of FIG. 2;

FIG. 5 shows a view from above of the collector of the machine of FIG. 2;

FIG. 6 shows a section, according to the section plane VIII-VIII, of the collector and of the recirculation pump of the system of FIG. 2.

DETAILED DESCRIPTION

FIGS. 2-6 are relative to a machine for the treatment of rope fabric according to a particular embodiment of the invention. Such a machine, indicated with overall reference numeral 30, comprises:

- a treatment tank 3 arranged for containing the rope fabric to be treated TC and a suitable treatment liquid;
- a drive system 33, arranged for driving and advancing the rope fabric TC along a suitable path inside the machine 1 and comprising for example a reel or cylinder, not shown;
- a recirculation system arranged for collecting and reusing the treatment liquid still contacted by the rope fabric TC in the machine 1.

The machine 30 can be arranged for carrying out the typical finishing operations, for example washing, dyeing, scouring and bleaching, and the treatment liquid, according to the treatment to be carried out, can for example be simply water, suitable aqueous solutions or other liquids. As shown in FIG. 4, the tank 3 and its inner chamber can, for example but not necessarily, have a substantially cylindrical shape with horizontal axis.

The recirculation system comprises:

- a recirculation pump 11';
- one or more nozzles 35 fed by the recirculation pump 11', and situated for example downstream of the drive system as well as outside and upstream of the tank 3;

one or more collecting ducts 37A, 37B each of them arranged for taking the treatment liquid from the bottom of the treatment tank 3 and bringing it to a collector 39 that feeds the recirculation pump 11'.

Each collecting duct 7A, 7B enters into the collector 39 at a relative entry nozzle 370A, 370B (FIG. 5).

According to an aspect of the invention, all of the collecting ducts 37A, 37B mutually feed in parallel the collector 39, and the head losses that the treatment liquid undergoes along the different collecting pipes 37A, 37B between the treatment tank 3 and the relative entry nozzle 370A, 370B are substantially the same; moreover, the head losses that the treatment liquid is subject to between an entry nozzle 370A, 370B and the entry mouth, or in any case the entry section 410 into the chamber 41 of the pump impeller are substantially the same for all of the entry nozzles 370A, 370B (FIGS. 5, 6).

In the present description the head losses along two ducts are considered to be the same if they differ from one another by no more than ±10%.

Preferably the head losses that the treatment liquid undergoes along the different collecting ducts (37A, 37B) between the treatment tank (3) and the relative entry nozzle (370A, 370B) into the collector (39) mutually differ at most by ±5% of the losses themselves, and the head losses that the treatment liquid undergoes between each entry nozzle (370A, 370B) into the collector (39) and the entry (410) into the chamber (41) of the pump impeller differ at most of ±5% between the various entry nozzles (370A, 370B).

More preferably, the head losses that the treatment liquid undergoes along the different collecting ducts (37A, 37B) between the treatment tank (3) and the relative entry nozzle (370A, 370B) into the collector (39) mutually differ at most by ±2.5% of the losses themselves, and the head losses that the treatment liquid undergoes between each entry nozzle (370A, 370B) into the collector (39) and the entry (410) into the chamber (41) of the pump impeller differ at most of ±2.5% between the various entry nozzles (370A, 370B).

Figure 1:
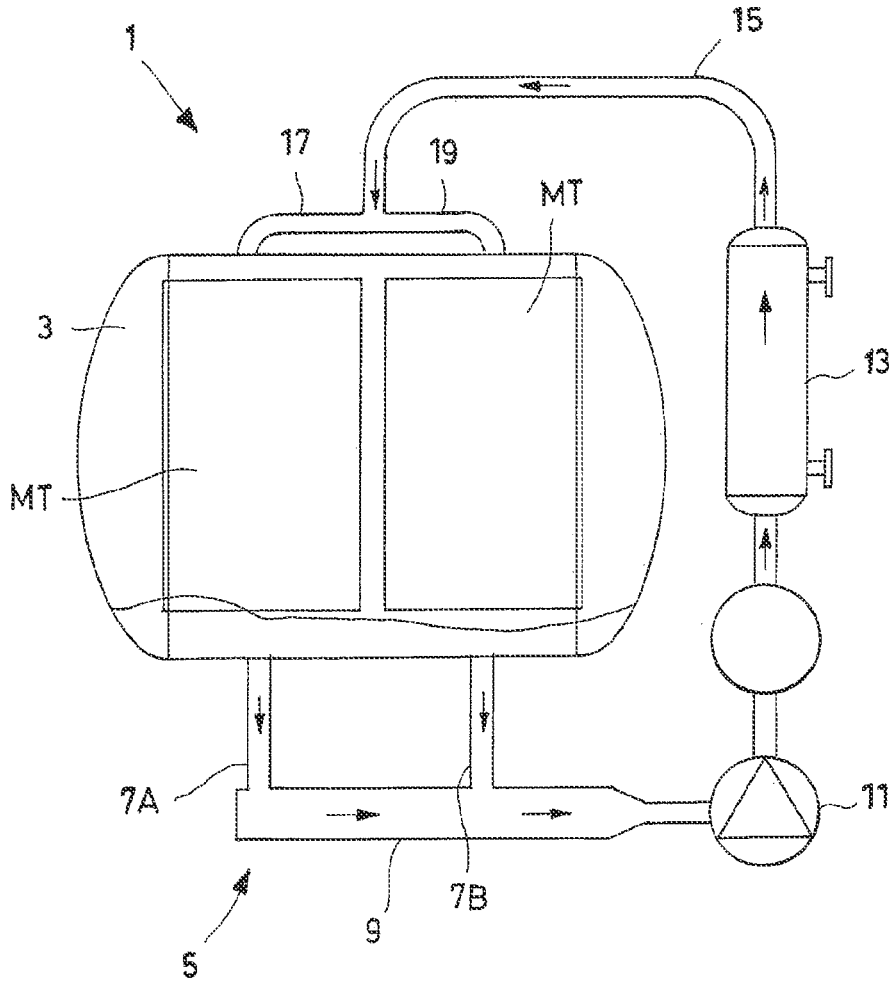
FIG. 1 shows a fluid diagram of a machine for dyeing rope fabrics according to the state of the art.

In this way, the treatment liquid that has accumulated on the bottom of the treatment tank 3 encounters, at the mouth 372A, 372B of the collecting ducts 37A, 37B into the tank 3 itself, resistances to outflow that are the same or very similar, and therefore it tends to divide evenly in the different collecting ducts 37A, 37B themselves. Consequently, the level of the treatment liquid accumulated on the bottom of the tank 3 is more even with respect for example to the known machine 1 of FIG. 1, even when on average it is very low, and it is thus possible to make the machine 30 work with much lower bath levels with respect to those of current known machines 1 using water without risks of aspiring air into the recirculation pump 11'.

Indicatively, the invention makes it possible to reduce the level of the bath on the bottom of a treatment tank of a generic machine, by about 15-40% with respect to known machines.

Advantageously, the pump 11' is a centrifugal turbopump, preferably with axial intake and radial delivery direction, as shown for example in FIGS. 5, 6. In this way, the pump 11' can offer much higher performance, in terms of head, flow rate and hydraulic efficiency, with respect to other types of pump, like for example positive-displacement or self-priming pumps. Thanks to the better performance, the pump 11' can have a smaller size and this, together with its much simpler mechanical construction with respect for example to positive-displacement pumps, makes the testing and qualification procedures of the machine 1 easier: indeed, often this type of machine must operate with a pressure of about 3-4.5 bar in the tank 3 and in the recirculation system.

Advantageously, the pump 11' is a centrifugal turbopump made self-priming thanks to the presence of:

a priming propeller 397, mounted on the same drive shaft as the centrifugal impeller 396 farther upstream than the latter, with reference to the flow of liquid that crosses the pump 11';

a priming duct 394.

As shown in FIG. 6, the priming propeller 397 can be provided for example with a helical thread that winds around the drive shaft for about half a turn.

In any case, the priming propeller 397 is arranged a certain axial distance from the centrifugal impeller 396. The latter can comprise for example a disc that extends substantially in a radial plane, and on which there is a plurality of paddles projecting in the axial direction. As shown in FIG. 5, such paddles can for example have a spiral shape or in any case a curved and not necessarily helical shape.

The priming duct 394 is arranged for concentrating around the priming propeller 397 the treatment liquid aspired by the propeller itself.

As shown in FIG. 6, the priming duct 394 can be formed for example inside a cylindrical bush the inner radius of which is slightly greater than, and in any case very close to, the maximum radial bulk of the priming propeller 397. Between the most outer portions, in the radial direction, of the propeller 397 and the inner walls of the priming duct 394 there is preferably a port equal to or smaller than quarter the maximum width, in the radial direction, of the propeller, more preferably, equal to or smaller than one fifth and, even more preferably, equal to or smaller than one tenth radially of such a maximum width of the propeller.

Preferably, such a port is a few millimeters or even a few tenths of a millimeter. For this purpose, the inner walls of the priming duct can be made from graphite or another material much softer than that from which the propeller 397 itself is made, so that by rotating on itself the latter cuts away at the duct 394 so as to create the aforementioned minimum port.

The priming propeller 397 and the centrifugal impeller 396 are fixedly connected with the drive shaft that actuates them.

Advantageously, during its normal operation, the rotary axis AR of the impeller of the recirculation pump 11' is substantially vertical, where by such an expression we mean that the rotary axis AR has an inclination with respect to the line of a plumb line, comprised between 0° and 40°. In this case, advantageously the propeller 397 is situated lower than the centrifugal impeller 396.

The centrifugal impeller 396 and the priming propeller 397 of the pump 11' can be actuated by an electric motor, not shown and preferably arranged above, or in any case at a greater height than, the impeller 396 and the propeller 397. The motor that actuates the pump clearly may also not be electric and for example pneumatic, hydraulic or an internal combustion engine. In any case, the fact that it is arranged above or in any case at a greater height than the impeller 396 and its chamber 392 makes it possible to position the impeller 396 and its chamber 392 very low down, and more specifically much lower down with respect to the treatment tank 3, contributing to reducing the risks of cavitation.

The collector 39 preferably comprises an outer casing 390 that internally forms an outer chamber 392, which in turn encloses the priming duct 394.

Advantageously, in order to make the different flows of treatment liquid coming from the different ducts 37A, 37B even more uniform, the latter and the collector 39 are symmetrical at least with respect to a vertical symmetry plane VIII-VIII (FIG. 5).

Advantageously, again to make the different flows of treatment liquid coming from the different ducts 37A, 37B even more uniform, the latter are substantially the same length and the same shape and size of their passage sections.

Advantageously, again to make the different flows of treatment liquid coming from the different ducts 37A, 37B even more uniform, the entry mouths 370A, 370B of such ducts into the collector 39 are arranged symmetrically and substantially equidistant from the centre of the entry opening 410 of the chamber 41 of the pump (FIG. 5).

Advantageously, to make the different flows of treatment liquid coming from the different ducts 37A, 37B even more uniform, in the middle of each of their outlets into the collector 39 there is a deflector 398 arranged to limit the turbulence at the entry and bring the entering flows alongside one another gradually.

Like in FIGS. 5, 6 the deflector 398 can be a flat plate arranged vertically, for example made from metal sheet. Alternatively, each deflector can be a flat plate that is not vertical or a suitably curved plate, with single or double curvature.

The collector 39 and the priming duct 394 of the impeller can be made for example from welded sheet. In the example of FIG. 5 the outer casing 390 is substantially the shape of a prism whose base is an irregular octagon. In FIGS. 2, 5, 6 reference numeral 38 indicates the delivery of the pump 11'.

Now we will describe the operation of the machine 30.

The drive system 33 advances the rope fabric TC, or other rope material to be treated, along the desired treatment path and closed upon itself, by lifting the rope fabric along the vertical length between the tank 3 and the drive system itself. The rope of fabric or other material to be treated, when it is treated in the machine 1, is also preferably closed upon itself, so as to substantially form a ring or loop.

At the height of the drive system 33 the rope fabric TC is wetted by the treatment liquid sprayed by the nozzles 35, and then slides along the inclined duct downstream of the drive system 33 once again towards the tank 3, where the rope fabric once again collects possibly forming loops and curls, after which it is pulled back up again by the drive system 33 until the desired number of treatment cycles has been completed.

The treatment liquid sprayed by the nozzles 35 and not held in the rope fabric TC drips downwards, collects on the bottom of the tank 3 and through the collecting ducts 37A, 37B reaches the recirculation pump 11'. Thanks to the various provisions of the recirculation system described above, the head losses that the treatment liquid undergoes by passing through the various collecting ducts 37A, 37B are substantially the same as one another or in any case sufficiently similar, and therefore the treatment liquid collected on the bottom of the tank 3 is sucked into the entry mouths 372A, 372B much more evenly that what occurred in known rope dyeing machines, for example in that of FIG. 1.

The recirculation pump 11' pumps the treatment liquid 3 back towards the nozzles 35, to be reused. More specifically, the two flows of treatment liquid coming out from the entry mouths 370A, 370B enter into the outer chamber 392, from here pass with much lower head losses in the priming duct 394, are sucked and expelled radially by the centrifugal impeller 396 and head towards the nozzles 35 along the delivery duct 38 (FIG. 6).

The pump 11' can continue to rotate also in the case of loss of prime, i.e. when the level of the treatment liquid in the collector 39 lowers to the point of leaving the centrifugal impeller 396 and at the extreme even the priming propeller 397 uncovered. Indeed, it is sufficient for the level of the treatment liquid to rise enough so as to resubmerge at least the priming propeller 397, for the latter, helped by the priming duct 394, to be able to suck an amount of liquid such as to prime the pump again.

From the previous teachings it is clear how a machine according to the invention can work with much lower bath ratios and bath levels, collected on the bottom of the tank 3, with respect to known machines, without worsening, and often substantially reducing, their electrical energy consumption. If the machine is for the treatment of rope fabrics of the so-called water-based type, thanks to the invention it can save the electricity consumption of a current water-based machine, maintaining comparable consumption of treatment liquid and bath levels, if not lower, than those of current air-based machines. For reasons of clarity, examples of machines for the dyeing or in any case the treatment of rope fabrics are described in Italian patents IT 1 291 626, IT 1 300 541, IT 1 366 872 and in Italian patent application n° MI2005A2083 filed by the same Applicant. The system for moving the rope of fabric inside the dyeing machine is basically formed from one or more roller conveyors, either smooth or with slats, and one or more nozzles. The machines for dyeing rope are commonly referred to as "water-based" if such nozzles are fed by a flow of water generated by suitable pumps (JET or FLOW systems or systems with nozzles having variable section), and "air-based" if the nozzles are fed by a flow of air produced by suitable fans.

A contribution to the reduction of the risks of cavitation is also made by the vertical arrangement of the axis AR of the pump 11': indeed, such an arrangement contributes to increasing the level and the head of the liquid aspired by the pump 11', as well as making the pressures of the treatment liquid at the outlets of the various ducts 37A, 37B into the collector 39 more similar to one another.

The particular choice of self-priming pump equipped with a centrifugal impeller 396 coaxial with a priming propeller 397 allows the recirculation system to operate with lower bath levels, with respect to known machines, in the treatment tank 3 and allows possible transients in which the centrifugal impeller 396 is not submerged to be overcome.

The example embodiments described above can undergo various modifications and variations without departing from the scope of protection of the present invention. For example, a recirculation system according to the invention can be applied not only to machines for the treatment of rope fabrics, but to any machine in which fabrics or other piece materials are treated by recirculating a treatment bath or in any case a treatment liquid. A machine according to the invention can be used to treat not only fabrics, knitted or of the warp/weft type, but also other flexible piece or sheet materials like for example nets, gauzes, felts, non-woven fabrics, sheets formed by extrusion or lamination. The recirculation system according to the invention can be applied not only to machines for the treatment of fabrics with a treatment tank having horizontal axis, but also to machines of a substantially different type like for example machines different from those for treating rope fabrics, machines with a treatment tank having a vertical axis or jiggers.

A machine according to the invention can also be provided with more than two collecting ducts 37A, 37B, and can for example have a number of between two and six, and more preferably between two and five.

The priming propeller 397 can also be provided with many helical threads, and each helical thread can wind around the drive shaft even for more or less than half a turn, for example for a quarter turn, three quarters of a turn or a complete turn.

Moreover, all of the details can be replaced by technically equivalent elements. For example, the materials used, as well as the sizes, can be whatever according to the technical requirements. The example and lists of possible variants of the present application should not be taken to be exhaustive lists.

The invention claimed is:

1. A machine (1) for the treatment of fabrics, nets, gauzes, felts, non-woven fabrics and other piece or sheet material, comprising:

A treatment tank (3) arranged for containing the fabric or other material (TC) to be treated and a treatment liquid;

a recirculation system arranged for collecting the treatment liquid still contacted by the fabric or other material to be treated in the treatment tank (3), wherein the recirculation system comprises:

a recirculation pump (11') arranged for pumping the treatment liquid towards the treatment tank (3) wherein said recirculation pump (11') comprises a centrifugal impeller (396) arranged for rotating around a rotary axis (AR) which, during its normal operation, is substantially vertical;

a plurality of collecting ducts (37A, 37B), each of them arranged for taking the treatment liquid out the treatment tank (3) and bringing it to a collector (39) feeding the recirculation pump (11'), wherein the recirculation system is so provide that:

Each collecting duct (37A, 37B) enters the collector (39) at a corresponding entry nozzle (370A, 370B);

All collecting ducts (37A, 37B) mutually feed in parallel the collector (39);

the head losses which the treatment liquid undergoes along the various collecting ducts (37A, 37B) between the treatment tank (3) and the corresponding entry nozzle (370A, 370B) in the collector (39) mutually differ at most of ±10% of the losses themselves;

the head losses which the treatment liquid undergoes between each entry nozzle (370A, 370B) in the collector (39) and the entry (410) in the chamber (41) of the pump impeller differ at most of +10% among the various entry nozzles (370A, 370B).

2. The machine (1) according to claim 1, wherein:

the head losses which the treatment liquid undergoes along the various collecting ducts (37A, 37B) between the treatment tank (3) and the corresponding entry nozzle (370A, 370B) in the collector (39) mutually differ at most of ±5% of the losses themselves;

the head losses which the treatment liquid undergoes among each entry nozzle (370A, 370B) in the collector (39) and the entry (410) in the chamber (41) of the pump impeller differ at most of ±5% among the various entry nozzles (370A, 370B).

3. The machine (1) according to claim 1, wherein the collecting ducts (37A, 37B) are substantially symmetrical at least with respect to a vertical symmetry plane (VIII-VIII).

4. The machine (1) according to claim 1, wherein the collector (39) is substantially symmetrical at least with respect to a vertical symmetry plane (VIII-VIII).

5. The machine (1) according to claim 1, wherein the recirculation pump (11') comprises a centrifugal impeller (396) and a priming propeller (397), wherein:

the centrifugal impeller (396) and the priming propeller (397) are arranged for pressing the treatment liquid downwards by rotating around a common rotary axis (AR), are mounted on the same drive shaft which actuates said centrifugal impeller (396) and said priming propeller (397) and the priming propeller (397) is mounted upstream with respect to the centrifugal impeller (396).

6. The machine (1) according to claim 5, wherein the priming propeller (396) is arranged for pressing the treatment liquid towards the centrifugal impeller (397) even when the latter is not submerged by the treatment liquid whereas the priming propeller (396) is submerged by the treatment liquid.

7. The machine (1) according to claim 5, comprising a priming duct (394) at least enclosing the priming propeller (396) and is arranged for collecting around it the treatment liquid aspired by the propeller itself.

8. The machine (1) according to claim 1, wherein the recirculation pump (11') is a turbopump with a radial discharge.

9. The machine (1) according to claim 5, wherein said centrifugal impeller (396) during its normal operation is placed substantially underneath or in any case lower than the treatment tank (3).

10. The machine (1) according to claim 1, comprising a drive system (33) arranged for advancing the fabric of other rope material (TC) to be treated along a suitable path inside the machine (1) itself and inside the treatment tank (3).

11. The machine (1) according to claim 1, wherein the drive system (33) comprises a roll or reel external to the treatment tank (3) and arranged for extracting the fabric or other rope material (TC) to be treated from the tank (3).

12. The machine (1) according to claim 1, wherein the recirculation system comprises one or more nozzles (35) arranged for spraying on the fabric or other rope material (TC) to be treated the treatment fluid coming from the recirculation pump, possibly by spraying it upon a portion of fabric or other rope material (TC) to be treated, placed outside the treatment tank (3).

* * * * *